United States Patent [19]

Tabardin

[11] Patent Number: 4,732,204

[45] Date of Patent: Mar. 22, 1988

[54] PROCESS FOR THE PREPARATION OF CERAMIC CORES

[75] Inventor: Jacky P. Tabardin, Villiers le Bel, France

[73] Assignee: Societe Nationale d'Etude et de Construction de Moteurs d'Aviation, "S.N.E.C.M.A." , Paris, France

[21] Appl. No.: 19,334

[22] Filed: Feb. 26, 1987

[30] Foreign Application Priority Data

Feb. 27, 1986 [FR] France ..... 86 02700

[51] Int. Cl.[4] ..... B22C 9/04

[52] U.S. Cl. ..... 164/35; 164/516; 164/45

[58] Field of Search ..... 164/34, 35, 45, 122.1, 164/122.2, 516, 517, 518, 519

[56] References Cited

U.S. PATENT DOCUMENTS 4,283,835 8/1981 Obrochta et al. ..... 164/45 X

FOREIGN PATENT DOCUMENTS 1508663 6/1970 Fed. Rep. of Germany .
789721 1/1958 France .
2053047 2/1981 United Kingdom .
2150874 7/1985 United Kingdom .

*Primary Examiner*—Kuang Y. Lin
*Attorney, Agent, or Firm*—Oblon, Fisher, Spivak, McClelland & Maier

[57] ABSTRACT

A process is disclosed for the preparation of ceramic cores which includes injection by means of a press of low power of liquid wax into cavities of a ceramic core disposed in a mould of elastomer produced by moulding of a dummy core which is a replica of the core to be produced.

4 Claims, 9 Drawing Figures

PROCESS FOR THE PREPARATION OF CERAMIC CORES

BACKGROUND OF THE INVENTION

1. Field of the Invention

The present invention relates to a method for the preparation of ceramic cores intended to be used for the precision casting of parts produced by means of lost-wax casting processes.

2. Summary of the Prior Art

The application of such casting processes of which the general technical knowledge is well dissemeninated within the foundry art is intended primarily for the production of high precision parts and is especially suited to the manufacture of aeronautical parts.

One example of such applications is the provision within turbine blades of very complex internal cooling arrangements. The manufacture of such parts by foundry procedures using the lost-wax process requires the use of ceramic cores which in order to reproduce these cooling arrangements, have inevitably multiple cavities, thin walls and complex shapes. As a result these cores are very fragile and it follows that multiple handling or the application of stresses risk causing damage by rupture or carcking.

The formation of wax models enrobing cores of this type in the processes of the lost-wax type thus encounter difficulties in practical application which are not wholly resolved satisfactorily by the operational procedures hitherto applied. In practice, the fragility of the cores hinders the injection of the wax, during the enrobing operation of the cores by the modelling wax, to a pressure sufficient to enable compensation for volumetric shrinkage of the wax in the larger volumes where local thicknesses are much greater. Now these shrinkages cause defects in the shape which show up in the parts to be made in a nonacceptable manner and furthermore it is not always possible to apply correcting measures in a repetitive manner in such a way as to correct such defects.

One solution to this problem, which the practitioners of the technical art concerned have tentatively sought to apply. consists in filling manually with liquid wax all the cavities of the ceramic cores before the enrobing operation. But this manual operation apart from inconveniences of practical application taking into account the costs, the prolongation of the manufacturing cycles, gives rise to numerous handling operations increasing the risks of damage resulting from the fragility of the cores and gives rise to the necessity of effecting numerous retouching operations, while at the same time essentially relying upon the dexterity of an operator.

An object of the present invention is to provide a method for the preparation of ceramic cores which resolves the problems hereinafter discussed.

SUMMARY OF THE INVENTION

According to the present invention there is provided a process for the production of ceramic cores intended for the casting of high precision parts by the lost-wax method, the process comprising the steps of:

(a) providing a core having cavities therein (b) providing a flexible mould, (c) by filling means of an injection moulding machine, the cavities of the core with modelling wax while the core is enclosed within the flexible mould, and (d) the enrobing core with modelling wax.

BRIEF DESCRIPTION OF THE DRAWINGS

The invention will now be described, by way of example only with reference to the accompanying diagrammatic drawings, in which.

DESCRIPTION OF THE PREFERRED EMBODIMENT

Figure 1:
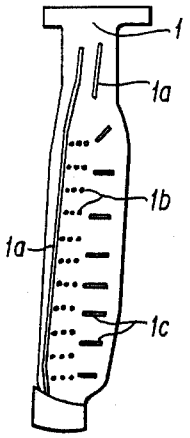
FIG. 1 illustrates a basic ceramic core which can be used in the application of the preparation process in accordance with the invention.

The ceramic core 1 illustrated in FIG. 1 is one example of the application of the invention. This core 1 is used in a precision foundry for the casting of a turbine blade by a process of the lost-wax type. Such blades comprise complex internal cooling arrangements. The example illustrated thus has internal walls 1a and various flow baffles 1b and reinforcing members 1c which define internal cavities of the blade. Such members define corresponding cavities formed in the ceramic core 1 which thus has complex elements of very fine character from which considerable fragility must result.

In a foundry process, of the kind referred hereinbefore, a ceramic core 1 must be enrobed with modelling wax. In order to ensure satisfactory results and to avoid nonacceptable defects in the shape resulting from phenomena of volumetric shrinkage of the wax in relatively massive zones where local thicknesses are substantial and at the same time the fragility of the core imposes limitations upon the injection pressure of the wax, it becomes necessary to fill with wax all the cavities of the ceramic core 1.

Figure 2:
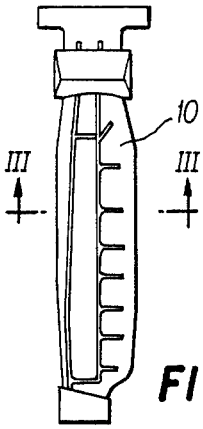
FIG. 2 illustrates a mock-up or dummy core.
Figure 3:
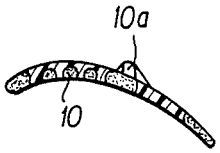
FIG. 3 illustrates, to an enlarged scale, a crosssection taken on the line III—III of the core illustrated in FIG. 2.

FIGS. 2 and 3 illustrate a mock-up or dummy core 10 which is similar to the ceramic core which is to be prepared for use in the actual casting of the blades. This mock-up or dummy core 10 is used for the manufacture by a moulding operation of a mould of flexible material, for example of the silicone elastomer type.

Figure 4:
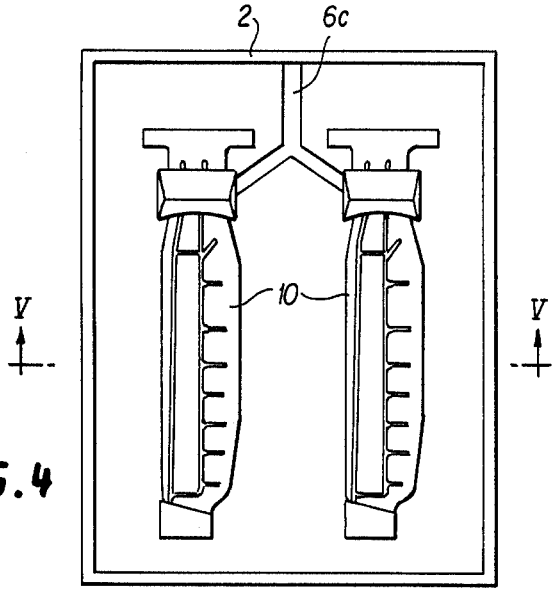
FIG. 4 illustrates a diagrammatic view of equipment for the casting around the mock-up or dummy core.
Figure 5:
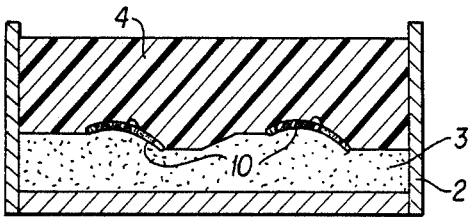
FIG. 5 is a cross-section taken on the line V—V of the equipment illustrated in FIG. 4.
Figure 6:
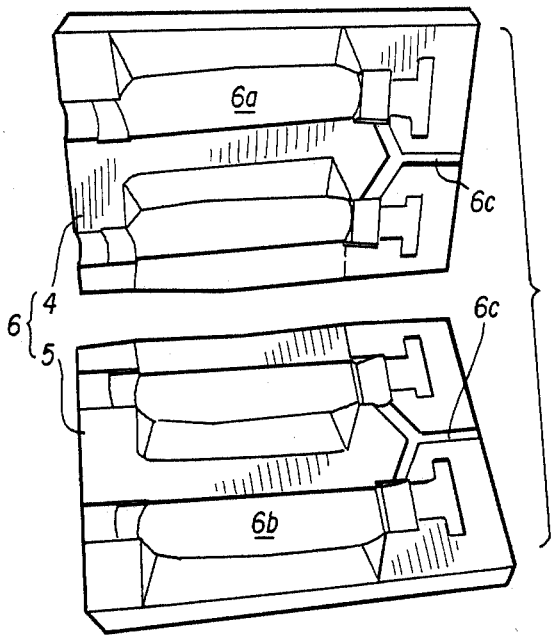
FIG. 6 is a diagrammatic perspective view of the two parts of a mould.

FIGS. 4 and 5 illustrate one example of putting this operation into practice. Two mock-up or dummy cores 10 are placed in a moulding box 2 on a layer 3 separating the cores for the moulding box base. An existing method for moulding using an injection runner **10*a* (see FIG. 3) formed on one face of the mock-up or dummy core 10 enables the production of a first part 4 of the mould in elastomer which defines one face of the mould and then a second part 5 of the mould defining a second face of the mould, as is illustrated in FIG. 6. The mould 6 thus comprises impressions, respectively 6*a* and 6*b*, of the two opposed faces of a mock-up or dummy core 10**.

An injection runner 6c is similarly provided on the mould 6.

Figure 7:
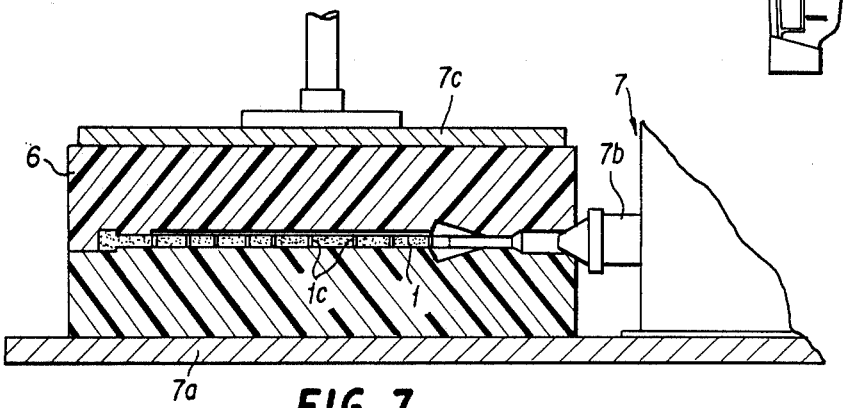
FIG. 7 is a view for carrying out the operation of filling up which comprises the preparation process of ceramic cores in accordance with the invention.

The process according to the invention consists in placing the fresh ceramic cores in a mould 6 of silicone elastomer and then placing the mould 6 onto the support plate 7a of a pressure injection moulding machine 7 illustrated only diagrammatically in FIG. 7. An injection head 7b of the machine is adapted to cooperate with the mould 6 and injects the liquid wax into the mould 6 where the runners 6c supply the wax to the thin passages leading to the cavities 1a, 1b or 1c of the ceramic core 1. The injection moulding machine 7 employed is of a sufficient capacity for the process and for adequate control of the injection pressure which lies between one and five bars. During the injection, a plate 7c of the injection moulding machine 7 applies a clamping pressure on the mould 6, of which the pressure value is a function of the injection pressure.

Figure 8:
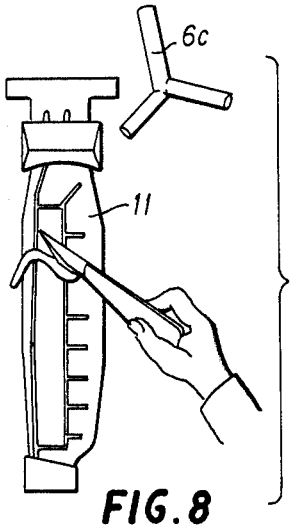
FIG. 8 illustrates the operation finishing of the core after filling up.
Figure 9:
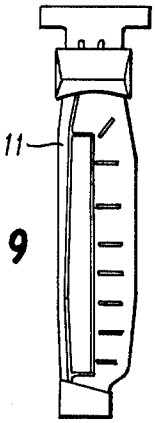
FIG. 9 illustrates an example of the final core prepared by the process according to the invention.

After injection of the wax and demoulding, a final retouching operation, as illustrated in FIG. 8, enables the elimination of injection runners connected to the prepared core and FIG. 9 illustrates the prepared core 11 ready for use in which the cavities have been filled with wax. FIG. 8 also illustrates the injection runners 6c, in outline.

The process according to the invention which has just been described provides numerous advantages in comparison with prior manual operations which were protracted and delicate. The cycle times are clearly reduced. The length of time for an average manual operation is estimated as between three to six minutes per core, while the process according to the invention reduces the operation to one half minute per core. The process reduces the need to handle the cores and as a consequence limits risks of breakage which are otherwise increased substantially as a result of the fragility of the cores. The deposit of wax produced is more regular and a repetitive quality which is reproducable is obtained.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A process for the production of ceramic cores intended for the casting of high precision parts by the lost wax method, the process comprising the steps of:

(a) providing a core having cavities therein, (b) providing a flexible mould, (c) filling by means of an injection moulding machine, the cavities of the core with modelling wax while the core is enclosed within the flexible mould, and (d) enrobing the core with modelling wax.

2. A process according to claim 1, wherein the flexible mould is of a silicone elastomer and is produced with the aid of a dummy core of a shape identical to that of the said core to be produced.

3. A process according to claim 1, wherein the injection pressure of the injection moulding machine is controlled to lie in the range 1 to 5 bars and a clamping pressure matched to the injection pressure of the machine is applied to the mould during the moulding operation.

4. A process according to claim 2, wherein the injection pressure of the injection moulding machine is controlled to lie in the range 1 to 5 bars and a clamping pressure matched to the injection pressure of the machine is applied to the mould during the moulding operation.

* * * * *